US008971787B2

(12) United States Patent
Kunii

(10) Patent No.: US 8,971,787 B2
(45) Date of Patent: Mar. 3, 2015

(54) PAPER EDGE CLEANER AND IMAGE FORMING APPARATUS USING THE PAPER EDGE CLEANER

(75) Inventor: Hiroyuki Kunii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 237 days.

(21) Appl. No.: 13/591,376

(22) Filed: Aug. 22, 2012

(65) Prior Publication Data

US 2013/0058697 A1 Mar. 7, 2013

(30) Foreign Application Priority Data

Sep. 3, 2011 (JP) ..... 2011-192183

(51) Int. Cl.

| | |
|---|---|
| ***G03G 15/00*** | (2006.01) |
| ***B65H 5/06*** | (2006.01) |
| ***B24B 19/22*** | (2006.01) |
| ***B24B 27/00*** | (2006.01) |
| ***B41J 11/00*** | (2006.01) |

(52) U.S. Cl.

CPC ..... *B24B 19/223* (2013.01); *B24B 27/0076* (2013.01); *G03G 15/6558* (2013.01); *B41J 11/0015* (2013.01); *B41J 11/0045* (2013.01); *G03G 2215/00708* (2013.01); *G03G 2215/0132* (2013.01)

USPC ..... 399/390

(58) Field of Classification Search

CPC ..... G03G 15/657; G03G 2215/00679; G03G 2215/00708; G03G 2215/00409; G03G 15/6582

USPC ..... 399/400, 388, 390; 162/194, 195, 260, 162/286

See application file for complete search history.

(56) References Cited

U.S. PATENT DOCUMENTS

| | | | | | |
|---|---|---|---|---|---|
| 2,217,306 | A | * | 10/1940 | Griswold | 156/535 |
| 2,392,375 | A | * | 1/1946 | Gardella | 451/188 |
| 3,129,541 | A | * | 4/1964 | Field | 451/511 |
| 2009/0136278 | A1 | * | 5/2009 | Derimiggio et al. | 399/400 |
| 2010/0164166 | A1 | | 7/2010 | Furusawa et al. | 271/9.13 |

FOREIGN PATENT DOCUMENTS

| | | | | | |
|---|---|---|---|---|---|
| JP | 06255229 | A | * | 9/1994 | B41M 1/00 |
| JP | 06295141 | A | * | 10/1994 | G03G 21/00 |
| JP | 10-218459 | | | 8/1998 | |
| JP | 2005-179041 | | | 7/2005 | |
| JP | 2005219367 | A | * | 8/2005 | B41M 5/40 |
| JP | 2009113948 | A | * | 5/2009 | G03G 15/00 |
| JP | 2009-198682 | | | 9/2009 | |
| JP | 2009234751 | A | * | 10/2009 | |
| JP | 2010-132403 | | | 6/2010 | |
| JP | 2010-276846 | | | 12/2010 | |
| JP | 2011-037555 | | | 2/2011 | |

* cited by examiner

*Primary Examiner* — Daniel J Colilla

(74) *Attorney, Agent, or Firm* — Oblon, McClelland, Maier & Neustadt, L.L.P.

(57) ABSTRACT

A paper edge cleaner in which paper is carried along a paper guide by a paper carrying roller. A grinder grinds both sides of the paper parallel to the paper movement to remove burrs from the paper. The paper is supported by a support.

12 Claims, 7 Drawing Sheets

PAPER EDGE CLEANER AND IMAGE FORMING APPARATUS USING THE PAPER EDGE CLEANER

CROSS-REFERENCE TO RELATED APPLICATIONS

This application is based on and claims priority pursuant to 35 U.S.C. §119 to Japanese Patent Application No. 2011-192183, filed on Sep. 3, 2011, the entire contents of which are incorporated herein by reference.

BACKGROUND

1. Field

The exemplary embodiments described herein relate to a paper edge cleaner for an image forming apparatus such as a copier, a printer, a facsimile machine, a printer, etc. and to an image forming apparatus that has a paper edge cleaner.

2. Description of the Related Art

An electrophotographic image-forming apparatus makes a copy or a print by transferring a toner image to paper, and fixes the toner image on the paper using heat and pressure. Many types of paper can be used. Moreover, a high image quality and a uniform glossiness are required for a full-color image, such as a photograph or a computer graphics image.

Uniform glossiness is prevented by a cutting burr that is made on a paper edge when the paper is cut, because the burr damages a fixing member in a fixing unit. When a plurality of same size papers are continuously used, the cutting burr on the edge of the paper contacts a same place on the fixing member and damages a surface on the fixing member at a fixing nip. Such damage causes an uneven glossiness line and a poor image. To solve this problem, applications JPH10-218459 and JP2005-179041 describe crushing the burr at the paper edge by a strong pressure provided by a pair of rollers.

However, the above-described rollers for crushing the burr have the following problems. Such rollers need a high pressure to crush the cutting burr on the paper. Therefore, such a roller system requires a big roller and a strong frame to maintain the high pressure, along with a strong driving source. This makes the apparatus bigger. Moreover, in this system, an impulsive sound occurs when the paper passes through the rollers.

SUMMARY

An exemplary embodiment provides a paper edge cleaner, comprising: a paper guide; a paper-carrying roller to transport a paper along the paper guide; a first grinder to grind both sides of the paper parallel to a direction of paper movement at a first surface; and a first support to support the paper when contacted by the first grinder.

Another exemplary embodiment provides an image forming method, comprising: feeding paper from a paper feeding unit; transporting the paper along a paper guide; grinding, using a grinder, both sides of the paper parallel to a direction of paper movement at a first surface, wherein the grinding step includes supporting the paper when contacted by the grinder; and forming an image on the paper grinded in the grinding step.

Another exemplary embodiment provides an image forming apparatus, comprising: a paper feeder to feed paper; an image forming device to form an image on the paper; and a paper edge cleaner provided between the paper feeder and the image forming device, the paper edge cleaner including a paper guide; a paper-carrying roller to transport the paper along the paper guide; a first grinder to grind both sides of the paper parallel to a direction of paper movement at a first surface; and a first support to support the paper when contacted by the first grinder.

BRIEF DESCRIPTION OF THE DRAWINGS

A more complete appreciation of the exemplary embodiments described herein and many of the attendant advantages thereof will be more readily obtained as the same becomes better understood by reference to the following detailed description when considered in connection with the accompanying drawings, wherein.

DETAILED DESCRIPTION

Figure 1:
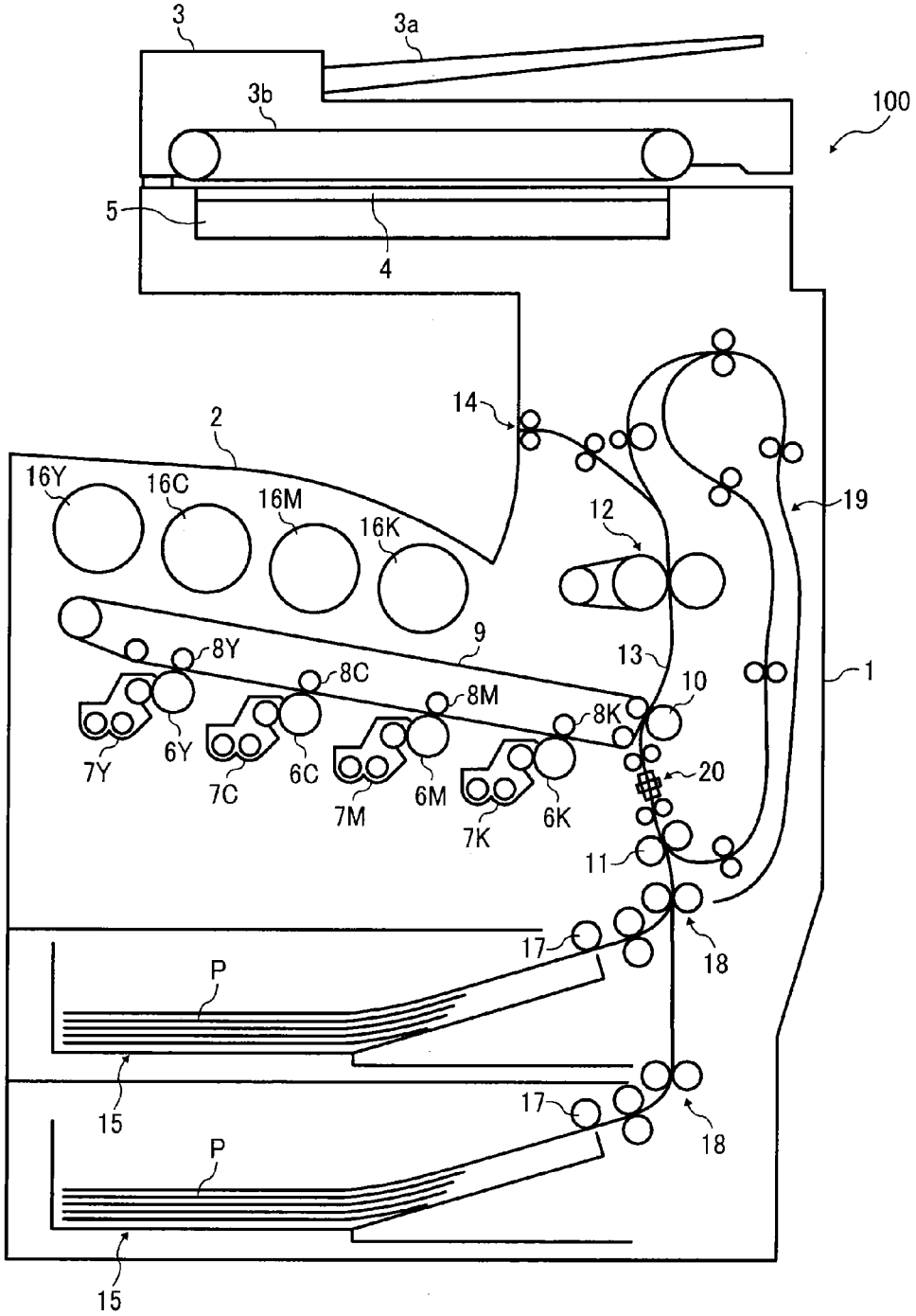
FIG. 1 is a schematic diagram showing an exemplary configuration of an image forming apparatus.

FIG. 1 schematically illustrates an image forming apparatus according to a first embodiment. The image forming apparatus 100 is a tandem-type, full-color electrophotography apparatus that is used in copiers or digital multi-functional apparatuses.

The image forming apparatus has a internal paper-eject structure that includes output paper tray 2 provided between an image scanner 5 and an image forming unit in a machine body 1. An openable and closable auto-document feeder (ADF) 3 is provided on the machine body 1. ADF 3 includes a document-setting board 3*a* and a document-carrying belt 3*b*. The image forming apparatus includes a contact glass 4 under the ADF.

The image scanner 5 under the contact glass 4 has an optical system including a light source and an imaging element. A document is set on the contact glass by a user or is fed to the contact glass by the ADF 3, where an image on the document is read by the scanner. The image forming apparatus includes an intermediate transfer belt 9 in a middle of the machine body 1, as shown in FIG. 1. Image forming units are provided under the intermediate transfer belt 9. The image forming units include an image forming unit for yellow, cyan, magenta, and black toner side-by-side along the intermediate transfer belt.

Each image forming unit includes a charger to charge a surface of each photoconductor 6Y, 6C, 6M, and 6K, and developing units 7Y, 7C, 7M, and 7K to develop each electrostatic latent image on the surface of each photoconductor that is formed by a writing unit. Primary transfer rollers 8Y, 8C, 8M, and 8K face each photoconductor 6Y, 6C, 6M, and 6K across the intermediate transfer belt 9.

There are two feeding paper trays 15 in a lower part of the machine body 1 that accommodate paper P as a recording medium. Further, there are corresponding paper feeding rollers 17 as paper feeding means to feed paper P from each paper feeding tray 15, several pairs of carrying rollers 18, and a registration roller 11 in the machine body 1. Further, the image forming apparatus includes a secondary transfer roller 10 contacting the intermediate transfer roller 9, and a fixing unit 12 over the secondary transfer roller 10.

The thin solid line in FIG. 1 shows a paper path 13 that is formed by several guide plates. The paper path 13 includes several pairs of carrying rollers, switching craws for switching a paper movement, and a pair of output paper rollers 14 at the end of the paper path 13. In a paper path 19 for double-faced printing, paper P, which has a toner image fixed on one side by a fixing unit 12, is reversed from front to back and carried to the registration roller 11.

A paper edge cleaner 20 is provided between the registration roller 11 and the secondary transfer roller 10 in the paper carrying path 13. Details of the paper edge cleaner are described below. Toner bottles 16Y, 16C, 16M, and 16K supply color toner to each developing unit 7Y, 7C, 7M, and 7K under the output paper tray 2 in the machine body 1.

The image forming apparatus 100 prints an image on paper P based on original document image data read by the image scanner 5 or print data sent from a host apparatus, such as a personal computer connected to a network. Each color toner image is formed on each respective photoconductor 6Y, 6C, 6M, and 6K in each corresponding image forming unit. Each color toner image is transferred to the intermediate transfer belt 9 sequentially and superimposed thereon. Then, a full color toner image is formed on the intermediate transfer belt. The full color toner image is carried to the secondary transfer unit in which the secondary transfer roller 10 faces the intermediate transfer belt 9.

Further, paper P in one of feeding paper trays 15 is carried to the registration roller 11 by the paper feeding roller 17 and pairs of carrying rollers 18. The paper is then sent by the registration roller 11 to meet the transferred toner image on the intermediate transfer belt 9 at the secondary transfer roller. After a paper edge cleaner removes cutting burr from the paper, the toner image on the intermediate transfer belt 9 is transferred to the paper P by the secondary transfer roller 10.

The paper P with the transferred toner image is carried to a fixing unit 12. The toner image is fixed by heat and pressure in the fixing unit 12. Thus, the paper with the fixed toner image is outputted to the output paper tray 2 by the pair of outputting paper rollers 14. When another toner image is formed on the other side of the paper, the paper with the fixed toner image on one side is carried to the paper path 19 for double-face printing, is held by the registration roller 11, and another toner image is transferred to the other side of the paper. The toner image is fixed in the fixing unit 12 and is output to the output paper tray 2.

Figure 2:
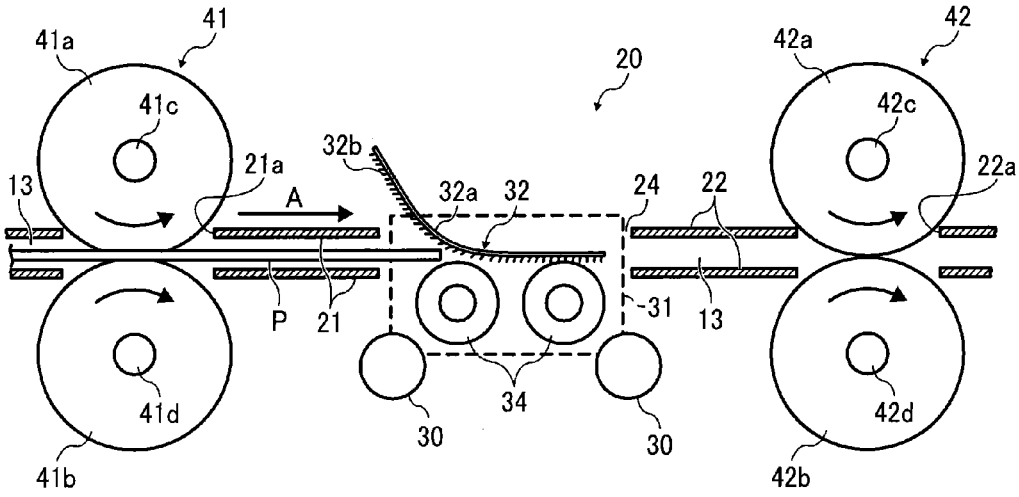
FIG. 2 is an enlarged lateral view of a paper edge cleaner 20 used in the image forming apparatus shown in FIG. 1 in the first embodiment.
Figure 3:
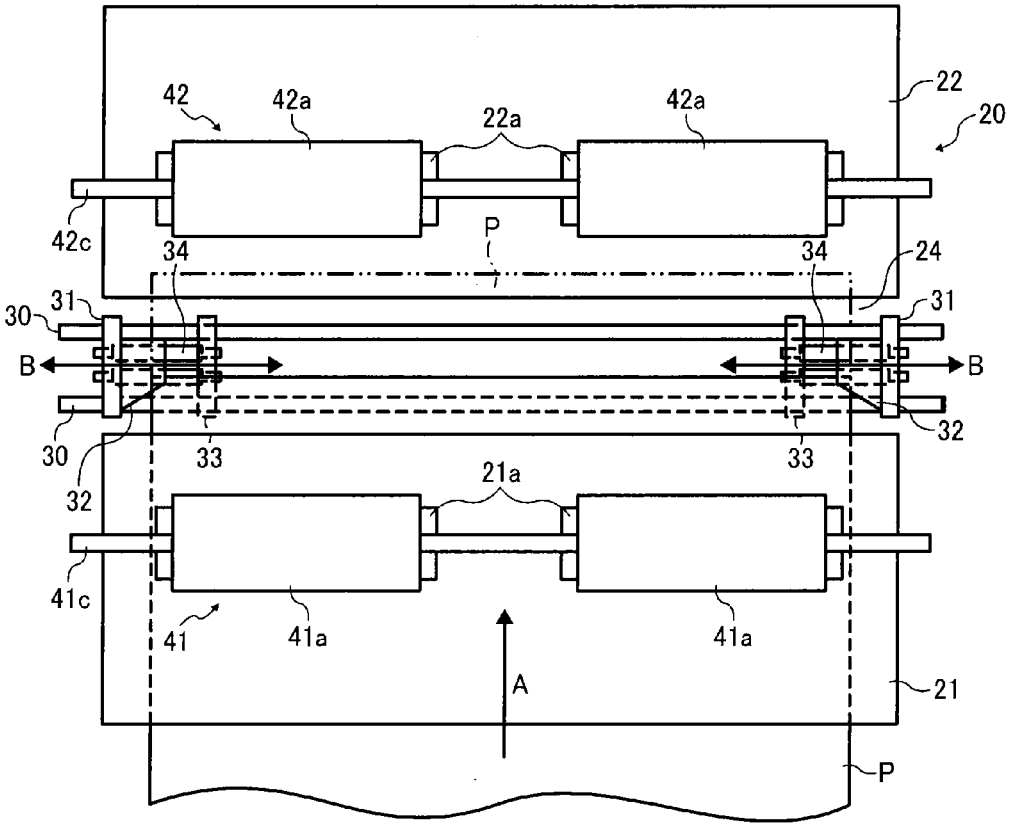
FIG. 3 is a plan view from above of the paper edge cleaner 20 in the first embodiment with a smaller scale than FIG. 2.

Details of a first embodiment of the paper edge cleaner 20 between the registration roller 11 and the secondary transfer roller 10 on the paper carrying path 13 is explained below with reference to FIGS. 2-11. FIG. 2 is an enlarged lateral view of a paper edge cleaner 20 in the first embodiment. FIG. 3 is a plan view from above of the paper edge cleaner 20 in the first embodiment in a smaller scale than that shown in FIG. 2.

The first embodiment is explained with reference to FIG. 2 and FIG. 3. The paper edge cleaner 20 includes two pairs of guide plates 21, 22 provided between the registration roller 11 and the secondary transfer roller 10 to form the paper carrying path 13, an elastic grinding plate 32 as a first grinding member provided in a space 24 shown in FIG. 2, a pair of carrying rollers 41 provided upstream of guide plates 21, a pair of carrying rollers 42 provided downstream of guide plate 22. The pairs of rollers 41, 42 carry paper along the guide plates 21, 22.

In the following explanation, "upstream" means upstream in the paper P movement, e.g., the left side in FIG. 2, and the down side in FIG. 3. "Downstream" means downstream in the paper P movement, e.g., the right side in FIG. 2 and the up side in FIG. 3. The space 24 between the guide plate 21 and the guide plate 22 in FIG. 3 is shown bigger than that in FIG. 2 for convenience. The plan views in other embodiments are similar.

The pair of carrying rollers 41 includes two carrying rollers 41 a fixed at an interval on the same axis 41*c* shown in FIG. 3, and two carrying rollers 41*b* fixed at an interval on the same axis 41*d* shown in FIG. 2. Upstream from guide plates 21, a pair of holes 21 a are formed at intervals in the width direction of the paper carrying path. The carrying roller 41*a* and the carrying roller 41*b* are set parallel and contact each other in the hole 21*a* of the upstream guide plate 21, as shown in FIG. 2. The carrying rollers rotate in the arrow direction shown, pinch the paper P, and carry it in the direction of arrow A in FIG. 2 between the pair of guide plates 21 in the paper carrying path 13.

The pair of carrying rollers 42 include two carrying rollers 42*a* fixed at an interval on the same axis 42*c* shown in FIG. 3 and two carrying rollers 42*b* fixed at an interval on the same axis 42*d* shown in FIG. 2. In the downstream guide plates 22, a pair of holes 22*a* are formed at intervals in the width direction of the paper carrying path. The carrying roller 42*a* and the carrying roller 42*b* are set parallel and contact each other in the hole 22*a* of the upstream guide plate 21, as shown in FIG. 2. The carrying rollers rotate in the arrow direction shown, pinch the paper P, and carry it in the direction of arrow A in FIG. 2 between the pair of guide plates 22 in the paper carrying path 13.

Rails 30 shown in FIGS. 2 and 3 are provided in a direction perpendicular to the paper movement. The rails 30 are provided under the paper carrying path 13 including the upstream pair of guide plates 21, the downstream pair of guide plates 22, and the space 24 between them, as shown FIG. 2. The rails 30 have base units 31 on the right and left sides that are movable in a plane parallel to the paper carrying path 13 and in a direction perpendicular to the paper movement shown by arrow B in FIG. 3.

A pair of elastic grinding plates 32 as a paper edge cleaner are provided in the paper carrying path 13 inside of the base units 31. Each elastic grinding plate has a SUS plate spring 32*a* attached to a grinding sheet 32*b* as a lapping film. To avoid getting the tip of the paper hung up on the elastic grinding plates 32, an upstream side of the plate spring 32*a* has a beveled form, as shown in FIG. 3, that increases width gradually from upstream to downstream, and is shaped to go down gradually and contact the paper carrying path shown in FIG. 2.

Facing members 33 are provided in the rails 30 under the pairs of guide plates 21, 22 to face each base unit 31 at a predetermined distance. A pair of supporting rollers is supported rotatable between a base unit 31 and a facing member 33. Each supporting roller supports the paper P pressed against the elastic grinding plate 32 to keep the paper P in the paper carrying path 13. The supporting rollers have an elastic layer. The supporting rollers are supported by a plastic axis, and are driven by the paper P to rotate.

In the first embodiment, a controller receives print information, identifies a width and type of the paper, drives base units 31 symmetrically along the rails 30 in a direction of the arrow B shown in FIG. 3, and sets the position of the base units suitable for the paper P. Hence the position of the elastic grinding plates is adjusted to contact both sides of the paper.

The registration roller 11 shown in FIG. 1 carries the paper P to the paper edge cleaner 20. The paper P is pinched by the pair of paper carrying rollers 41 shown in FIG. 2 and FIG. 3 and carried along a direction of the arrow A along the paper carrying path 13. Both sides parallel to the paper movement of the paper P are pinched by the elastic grinding plates 32 and the supporting rollers 34, and are moved between them. Edges on both sides of the paper P are grinded by the grinding sheet 32*b* on the elastic grinding plates 32. Therefore, the cutting burr on the edges is removed.

Figure 12:
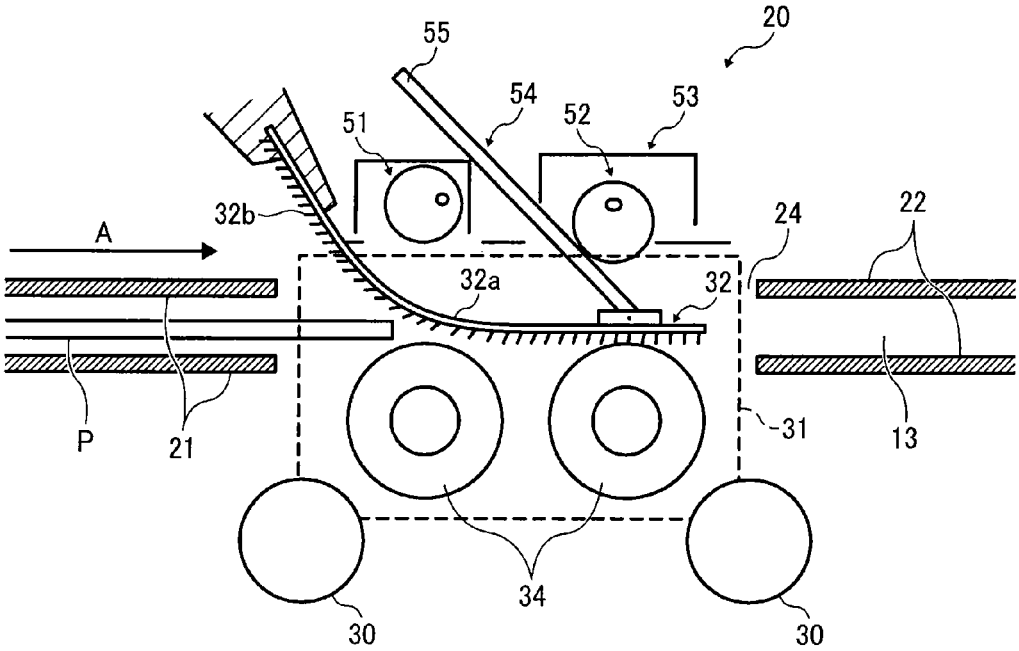
FIG. 12 is a lateral view of a driving member to move the first grinding member from a position distant from the paper to a position in which the first grinding member presses the paper.

After a tip of the paper P is pinched by the pair of carrying rollers 42, the paper P is carried in a direction of the arrow A by the pair of carrying rollers 42. When the paper type identified by the controller does not need grinding of the edge of the paper, cams 51,52 shown in FIG. 12 make the elastic grinding plates 32 move upward and separate from the paper path. First, cam 52 rotates to separate from rods 54. Next, cam 51 rotates to lift the rods 54. Tips of the rods 54 are fixed on the elastic grinding plates 32. Then, they separate the elastic grinding plates 32 from the paper path. When a type of the paper is a hard, thick paper, cams 51,52 make the elastic grinding plates 32 press both sides of the paper. The cam 51 rotates to depart from the rods 54. Next, the cam 52 is rotated precisely by a pulse motor to change pressure from the rods to the paper sides. The supporting rollers 34 can move to modify the pressure.

Because the grinding sheets 32*b* on the elastic grinding plates 32 grind both sides of the paper carried to the secondary transfer, the cutting burr of the paper can be removed. Therefore, in the image forming apparatus 100 having this paper edge cleaner, because the side of the paper does not cause damage to a surface of the fixing member, a poor image, e.g., having an uneven glossiness line, is prevented.

In the first embodiment, a tip of the paper does not get hung up on the elastic grinding plates 32 because the upstream side of the plate spring 32*a* has a beveled form that increases in width gradually from upstream to downstream, and bends down gradually to contact the paper carrying path. However, it is acceptable that the plate spring 32*a* at least bends down gradually to contact the paper carrying path, without having the beveled form.

Figure 4:
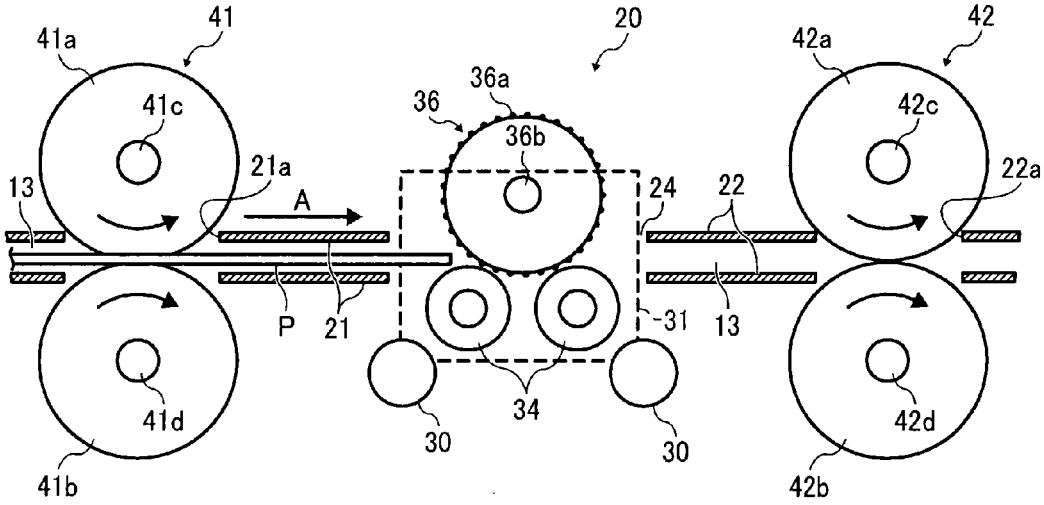
FIG. 4 is an enlarged lateral view of a paper edge cleaner 20 used in the image forming apparatus shown in FIG. 1 in the second embodiment similar to FIG. 2.
Figure 5:
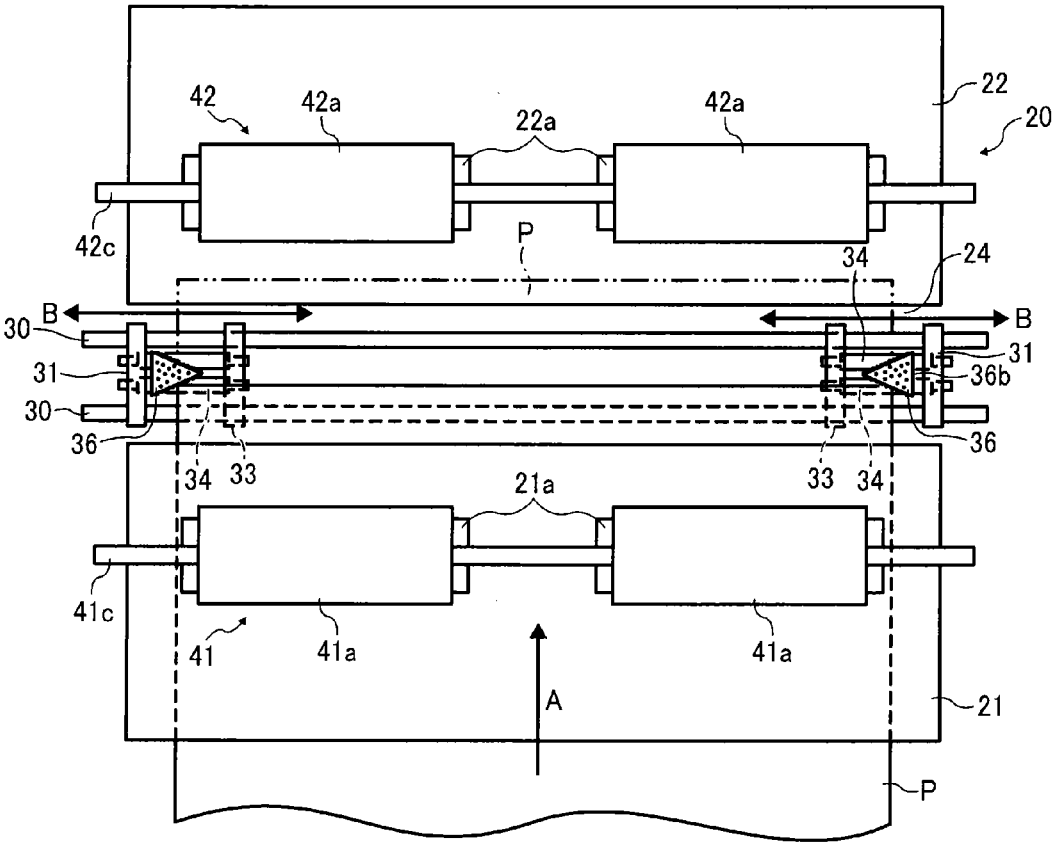
FIG. 5 is a plan view from above of the paper edge cleaner 20 in the second embodiment similar to FIG. 3.

A second embodiment of the paper edge cleaner is explained with reference to FIG. 4 and FIG. 5. FIG. 4 is a lateral view of the second embodiment similar to FIG. 2 in the first embodiment. FIG. 5 is a plan view of the second embodiment similar to FIG. 3 in the first embodiment. In these figures, the same parts shown in FIG. 2 and FIG. 3 have the same reference numbers, and their detailed explanation is not repeated.

A difference between the first embodiment and the second embodiment is the paper edge cleaners that are set inside of the base units 31. A pair of grinding rollers 36 serving as the paper edge cleaner is attached as shown in FIG. 4 and FIG. 5, instead of the elastic grinding plates 32 in the first embodiment.

Each grinding roller 36 has a conical shape whose top is located in the paper carrying path 13, and whose bottom is supported rotatably at an axis 36*b* in each base unit 31. A conical surface of the grinding rollers is covered by fine abrasives 36*a*. Both sides of the paper carried along the paper path 13 are pinched by the pair of grinding rollers 36 and the supporting rollers 34 and are grinded.

In the second embodiment, a controller receives print information, identifies a width and type of the paper, drives base units 31 symmetrically along the rails 30 in a direction of the arrow B shown in FIG. 5, and sets the position of the base units suitable for the paper P. Hence the position of the grinding rollers is adjusted to contact both sides of the paper.

The paper P is carried by the pair of paper carrying rollers 41 in a direction of the arrow A shown in FIG. 4 and FIG. 5. Both sides of the paper P are pinched by the grinding roller 36 and the supporting rollers 34 and moved between them. Edges on both sides of the paper P are grinded by the grinding roller 36. Therefore, the cutting burr on the edges is removed.

It is preferable that the grinding rollers 36 have an amount of rotational load and skid on the paper P to grind it. The second embodiment has the same effect as the first embodiment. An alternative embodiment for thick papers and paper that does not need grinding can be similarly provided.

Figure 6:
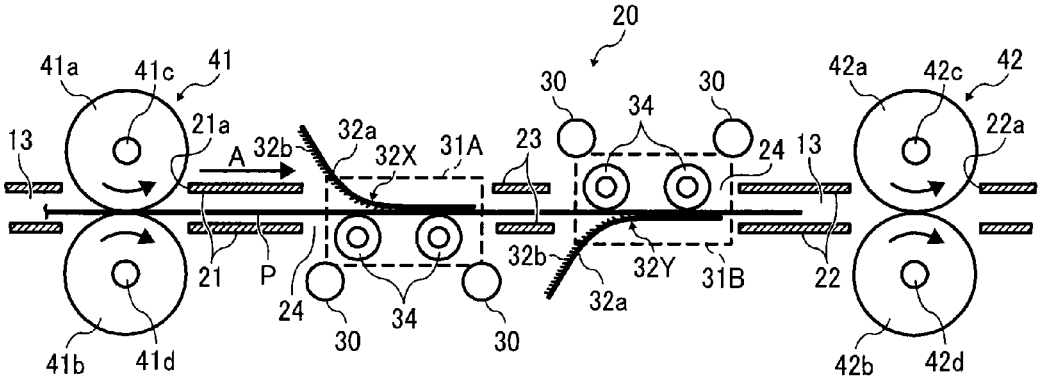
FIG. 6 is an enlarged lateral view of a paper edge cleaner 20 used in the image forming apparatus shown in FIG. 1 in the third embodiment similar to FIG. 2.
Figure 7:
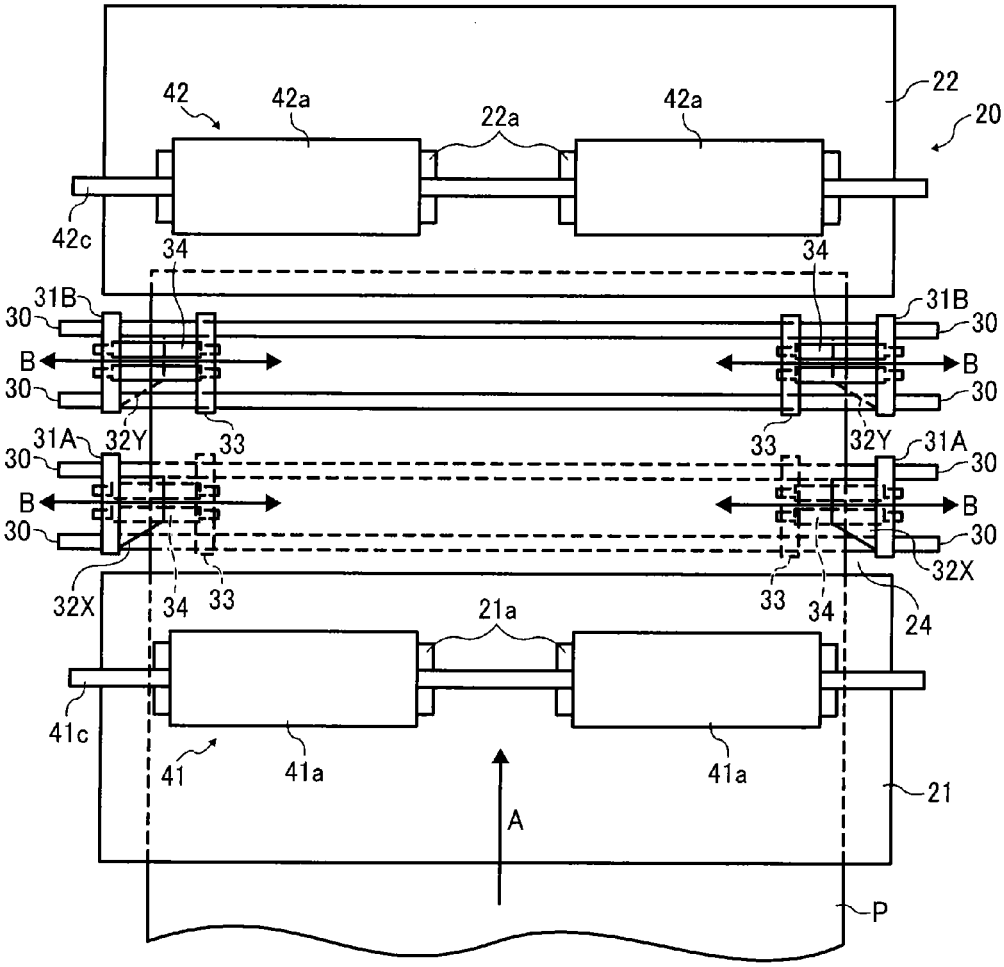
FIG. 7 is a plan view from above of the paper edge cleaner 20 in the third embodiment similar to FIG. 3.

A third embodiment of the paper edge cleaner is explained with reference to FIG. 6 and FIG. 7. FIG. 6 is a lateral view of the third embodiment similar to FIG. 2 in the first embodiment. FIG. 7 is a plan view of the third embodiment similar to FIG. 3 in the first embodiment. In these figures, the same parts shown in FIG. 2 and FIG. 3 have the same reference numbers and their detailed explanation is not repeated.

A difference between the first embodiment and the third embodiment is two pairs of elastic grinding plates 32X, 32Y along the paper carrying path 13 in the large space 24 between the upstream pair of guide plates 21 and the downstream pair of guide plates 22, as shown in FIG. 6 and FIG. 7. The paper edge cleaner includes a pair of base units 31A in the upstream of the paper movement (the direction of the arrow A) and a pair of base units 31B arranged on the opposite side of the paper carrying path from the pair of base units 31A. The third embodiment includes facing members 33, supporting rollers 34, and rails 30 for supporting them in the upstream side and the downstream side.

A pair of elastic grinding plates 32X is provided on one side of the paper carrying path 13 inside of the base units 31A facing each other to contact with a surface on the one side of the paper. Another pair of elastic grinding plates 32Y is provided on an opposite side of the paper carrying path 13 inside of the base units 31B, facing each other to contact with another surface on the opposite side of the paper. Further, there is a pair of short guide plates 23 in a middle of the space 24, as shown in FIG. 6.

In the third embodiment, a controller receives print information, identifies a width and type of the paper, drives base units 31A, 31B symmetrically along the rails 30 in a direction of the arrow B shown in FIG. 7, and sets the position of the base units suitable for the paper P. Then the grinding sheet 32*b* on the elastic grinding plate 32X contacts one surface on both sides of the paper. The grinding sheet 32*b* on the elastic grinding plate 32Y contacts another surface on both sides of the paper.

The paper P is carried by the pair of paper carrying rollers 41 in a direction of the arrow A shown in FIG. 6 and FIG. 7. Both sides of the paper P are pinched by the elastic grinding plates 32X and the supporting rollers 34 and moved between them. The edges of one surface on both sides of the paper P are grinded by the grinding sheet 32*b*. Therefore, the cutting burr on the edges of one surface is removed. Next, the paper P is carried to the grinding plate 32Y. Both sides of the paper P are pinched by the elastic grinding plates 32Y and the supporting rollers 34 and moved between them. The edges of another surface on both sides of the paper P are grinded by the grinding sheet 32*b*. Therefore, the cutting burr on the edges of another surface is removed.

The exemplary paper edge cleaner according to the third embodiment can remove cutting burr on surfaces on both sides of the paper because it grinds the paper surfaces in the paper carrying path 13. Thus, this embodiment has the same effect as the other embodiments described above. The above modifications for the paper type also apply to this embodiment. Either the elastic grinding plates 32X or the elastic grinding plates 32Y or both can be replaced by the grinding rollers similar to the grinding rollers 36 in the second embodiment shown in FIG. 4 and FIG. 5.

Figure 8:
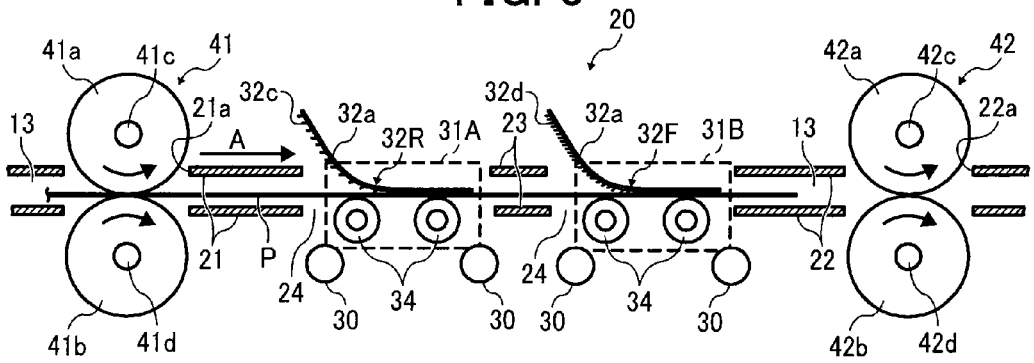
FIG. 8 is an enlarged lateral view of a paper edge cleaner 20 used in the image forming apparatus shown in FIG. 1 in the fourth embodiment similar to FIG. 2.

A fourth embodiment of the paper edge cleaner is explained with reference to FIG. 8 and FIG. 9. FIG. 8 is a lateral view of the fourth embodiment similar to FIG. 2 in the first embodiment. FIG. 7 is a plan view of the fourth embodiment similar to FIG. 3 in the first embodiment. In these figures, the same parts shown in FIG. 2 and FIG. 3 have the same reference numbers and their detailed explanation is not repeated.

Figure 9:
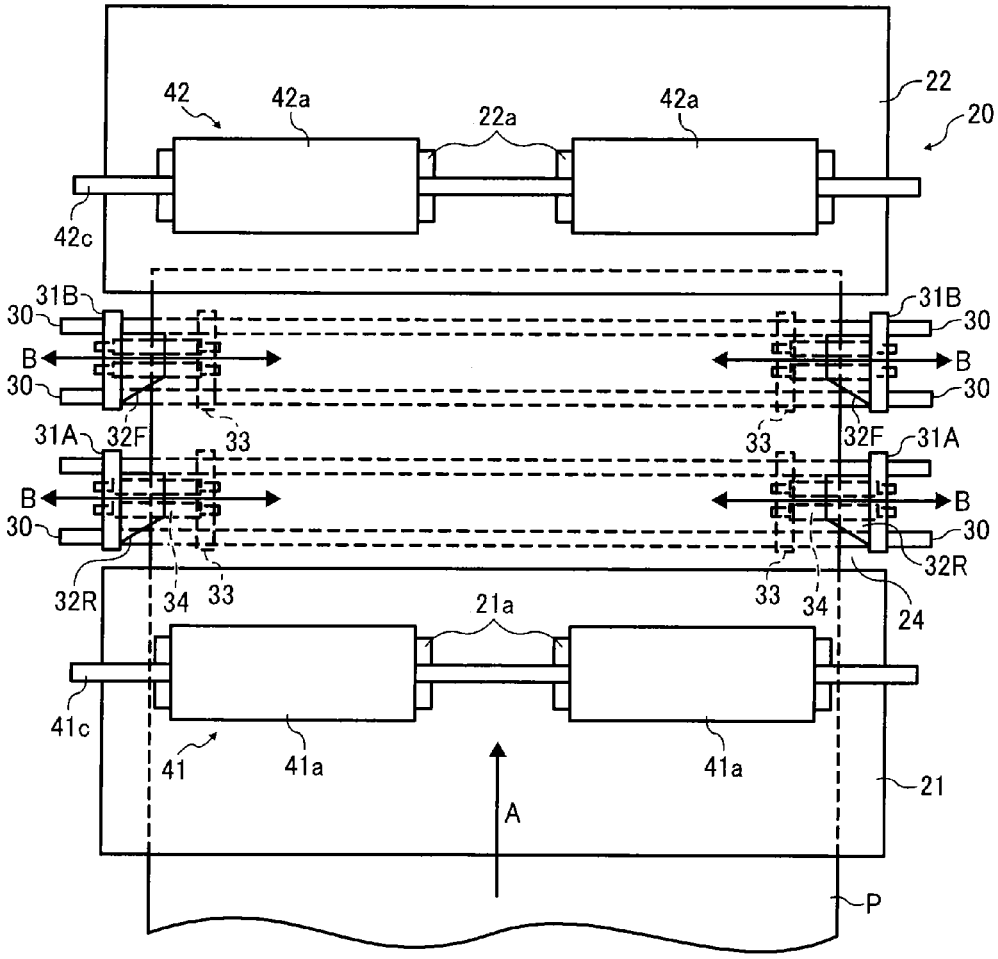
FIG. 9 is a plan view from above of the paper edge cleaner 20 in the fourth embodiment similar to FIG. 3.

A difference between the first embodiment and the fourth embodiment is two pairs of the elastic grinding plates 32R, 32F along the paper carrying path 13 in the large space 24 between the upstream pair of guide plates 21 and the downstream pair of guide plates 22, as shown in FIG. 8 and FIG. 9. This arrangement is similar to that of the third embodiment. However, in the fourth embodiment, a downstream side structure, i.e., the base unit 31B, the facing member 33, the supporting roller 34, and rails 30, is similar to the upstream side structure of the first embodiment shown in FIG. 2 and FIG. 3.

Rough grinding sheets 32*c* are attached to the plate springs 32*a* of the upstream elastic grinding plates 32R. Fine grinding sheets 32*d* are attached to the plate springs 32*a* of the downstream elastic grinding plates 32F. Further, there is a pair of short guide plates 23 in the middle of the space 24, as shown in FIG. 8.

In the fourth embodiment, a controller receives print information, identifies a width and type of the paper, drives base units 31A, 31B symmetrically along the rails 30 in a direction of the arrow B shown in FIG. 9, and sets the position of the base units suitable for the paper P. Then, the grinding sheet 32*c* on the elastic grinding plate 32R contacts one surface on both sides of the paper. The grinding sheet 32*d* on the elastic grinding plate 32F contacts a same surface on both sides of the paper.

The paper P is carried by the pair of paper carrying rollers 41 in the direction of the arrow A shown in FIG. 8 and FIG. 9. Both sides of the paper P are pinched by the elastic grinding plates 32R and the supporting rollers 34 and moved between them. The edges on both sides of the paper P are grinded by the rough grinding sheet 32*c*. Therefore, larger cutting burrs on the edges of one surface are removed.

Next, the paper P is carried to the grinding plate 32F. Both sides of the paper P are pinched by the elastic grinding plates 32F and the supporting rollers 34 and moved between them. The edges on both sides of the paper P are grinded by the fine grinding sheet 32*d*. Therefore, smaller cutting burrs on the edges are removed. Thus, the edges on both sides of the paper P become smooth.

In this embodiment, larger cutting burrs can be removed by the rough grinding sheets 32*c* of the upstream elastic grinding plates 32R. Further, smaller cutting burrs can be removed by the fine grinding sheets 32*d* of the downstream elastic grinding plates 32F. Thus, the paper edges become smoother.

The effect of this embodiment is similar to the effect of the other embodiments described above. The above modifications for the paper type also apply to this embodiment. Further, either the elastic grinding plates 32R or the elastic grinding plates 32F or both can be replaced by the grinding rollers such as the grinding rollers 36 used in the second embodiment, as shown in FIG. 4 and FIG. 5.

It is preferable that some pairs of the paper edge cleaner are provided in the direction of the paper movement. Especially, it is preferable that each paper edge cleaner have a different surface roughness in the direction of the paper movement. Further, it is more preferable that downstream paper edge cleaners have finer grinding surfaces.

Figure 10:
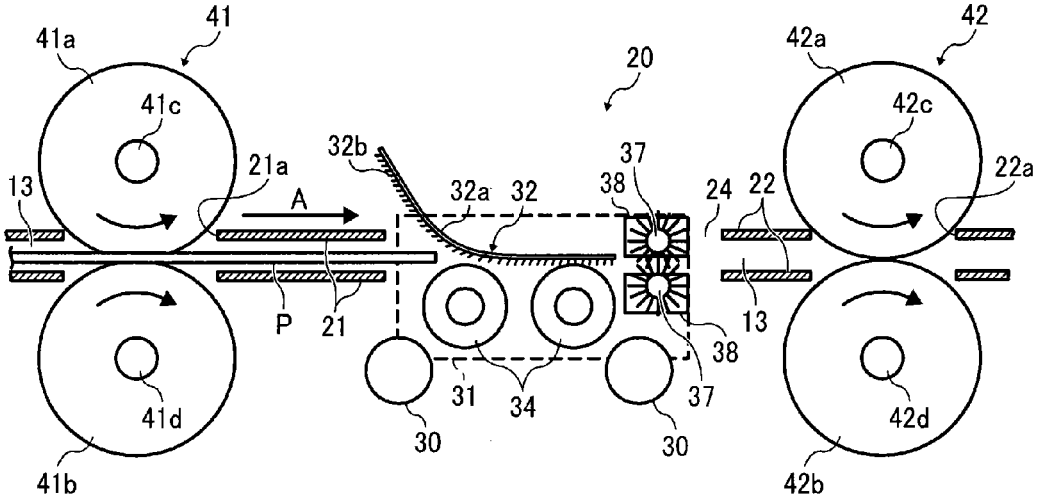
FIG. 10 is an enlarged lateral view of a paper edge cleaner 20 used in the image forming apparatus shown in FIG. 1 in the fifth embodiment similar to FIG. 2.
Figure 11:
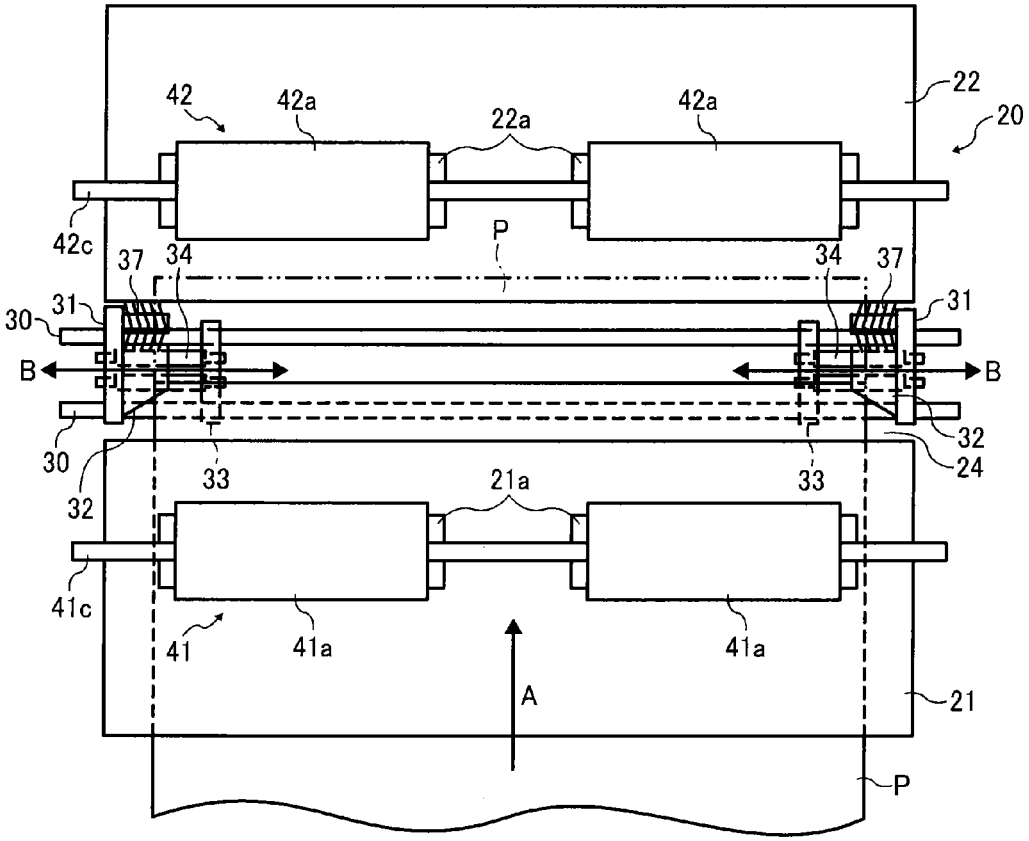
FIG. 11 is a plan view from above of the paper edge cleaner 20 in the fifth embodiment similar to FIG. 3.

A fifth embodiment of the paper edge cleaner is explained with reference to FIG. 10 and FIG. 11. FIG. 10 is a lateral view of the fifth embodiment similar to FIG. 2 in the first embodiment. FIG. 11 is a plan view of the fifth embodiment similar to FIG. 3 in the first embodiment. In these figures, the same parts shown in FIG. 2 and FIG. 3 have the same reference numbers and their detailed explanation is not repeated.

A difference between the first embodiment and the fifth embodiment is pairs of rotatable paper dust-cleaning brushes 37 facing each other across the paper carrying path 13 inside of the base unit 31 as a paper dust cleaner.

The paper dust-cleaning brushes are provided inside of the base unit 31 downstream from the elastic grinding plates 32 including the plate springs 32*a* and the grinding sheets 32*b*. Air suction ports 38 connected with an air suction pump are provided near bases of the paper dust-cleaning brushes to suction paper dust present in the paper dust-cleaning brushes.

In the fifth embodiment, the grinding sheets 32*b* of the elastic grinding plates 32 grind edges on both sides of the paper carried along the paper carrying path 13, and remove cutting burr in a manner similar to the first embodiment. The paper dust cleaning brushes 37 contact both surfaces at both edges of the paper P and clean paper dust residing there. The paper dust is suctioned to the air suction port 38 by the air suction pump. As a result, skidding of the paper movement and contamination by paper dust are prevented.

The exemplary paper edge cleaner according to this embodiment has paper dust cleaning brushes 37 downstream of the paper movement from the base units 31 of the first embodiment. Similarly, the paper dust-cleaning brush can be provided downstream of the paper movement from the base units 31 of the second to fourth embodiments. The paper dust-cleaning brushes may be provided not only in the base units 31, but also in another part independently downstream of the paper movement from the base units attached to the paper edge cleaners.

The image forming apparatus 100 has a paper edge cleaner 20 in various embodiments between the registration roller 11 and the secondary transfer roller 10 in the paper carrying path 13. However, the location of the paper edge cleaner is not limited to this. The paper edge cleaner 20 can be set anywhere between the paper feeding device to feed the paper (paper feeding roller 17 in FIG. 1) and the transfer part to transfer a toner image to the paper fed by the feeding device in the paper carrying path. Further, a paper carrying means is not limited only to rollers, but can also include belts.

The image forming apparatus is not limited to a tandem-type, intermediate-transfer, full-color apparatus. Other embodiments in other color printers can include a direct transfer system or another intermediate transfer system, black and white printers, copiers or fax machines including a scanner, and one of the above printers and multi-functional digital machines.

Numerous additional modifications and variations of the disclosed exemplary embodiments are possible in light of the above teachings. It is therefore to be understood that within the scope of the appended claims, the embodiments may be practiced otherwise than as specifically described herein.

The invention claimed is:

1. A paper edge cleaner, comprising:

a paper guide;

a paper-carrying roller to transport paper along the paper guide;

a first grinder to grind both sides of the paper parallel to a direction of paper movement at a first surface; and a first support facing the first grinder to press the paper against the first grinder, wherein the first support is a pair of support rollers.

2. The paper edge cleaner as claimed in claim 1, further comprising:

a second grinder to grind both sides of the paper parallel to a direction of the paper movement at a second surface on a back side of the paper from the first surface; and a second support facing the second grinder to press the paper against the second grinder.

3. The paper edge cleaner as claimed in claim 1, further comprising:

a second grinder to grind both sides of the paper parallel to a direction of the paper movement at the first surface that is grinded by the first grinder; and a second support facing the second grinder to press the paper against the second grinder.

4. The paper edge cleaner as claimed in claim 3, wherein the first grinder has a coarser grinding surface than a grinding surface of the second grinder.

5. The paper edge cleaner as claimed in claim 3, wherein the paper carrying roller includes two pairs of rollers;

the first grinder, the first support, the second grinder, and the second support are located between the two pairs of rollers; and a distance between the two pairs of rollers is shorter than a length of the paper.

6. The paper edge cleaner as claimed in claim 1, further comprising:

a driving member to move the first grinder from a position distant from the paper to a position at which the first grinder grinds the paper.

7. The paper edge cleaner as claimed in claim 1, wherein the first grinder includes a grinding sheet attached to an elastic plate.

8. The paper edge cleaner as claimed in claim 1, wherein the first grinder includes a conical roller having an abrasive conical surface.

9. The paper edge cleaner as claimed in claim 1, further comprising:

a paper dust cleaner located downstream from the first grinder in a direction of the paper movement.

10. The paper edge cleaner of claim 2, wherein the second support is a pair of support rollers.

11. An image forming apparatus, comprising:

a paper feeder to feed paper;

an image forming device to form an image on the paper; and a paper edge cleaner provided between the paper feeder and the image forming device, the paper edge cleaner including a paper guide;

a paper-carrying roller to transport the paper along the paper guide;

a first grinder to grind both sides of the paper parallel to a direction of paper movement at a first surface; and a first support facing the first grinder to press the paper against the first grinder, wherein the first support is a pair of support rollers.

12. An image forming method, comprising:

feeding paper from a paper feeding unit;

transporting the paper along a paper guide;

grinding, using a grinder, both sides of the paper parallel to a direction of paper movement at a first surface, wherein the grinding step includes pressing, by a support facing the grinder, the paper against the grinder, wherein the support is a pair of support rollers; and forming an image on the paper grinded in the grinding step.

* * * * *